US009113723B2

(12) United States Patent
Greger et al.

(10) Patent No.: US 9,113,723 B2
(45) Date of Patent: Aug. 25, 2015

(54) BASSINET FOR A PLAYARD

(75) Inventors: Jeff G. Greger, Lititz, PA (US); Michael L. Longenecker, Lancaster, PA (US)

(73) Assignee: ARTSANA USA, INC., Lancaster, PA (US)

( * ) Notice: Subject to any disclaimer, the term of this patent is extended or adjusted under 35 U.S.C. 154(b) by 783 days.

(21) Appl. No.: 13/422,063

(22) Filed: Mar. 16, 2012

(65) Prior Publication Data

US 2012/0233770 A1 Sep. 20, 2012

Related U.S. Application Data

(60) Provisional application No. 61/453,501, filed on Mar. 16, 2011.

(51) Int. Cl.

| | |
|---|---|
| ***A47D 13/06*** | (2006.01) |
| ***A47D 7/00*** | (2006.01) |
| ***A47D 9/00*** | (2006.01) |

(52) U.S. Cl.

CPC ..... *A47D 13/063* (2013.01); *A47D 9/00* (2013.01); *A47D 9/005* (2013.01); *A47D 13/061* (2013.01); *A47D 7/002* (2013.01)

(58) Field of Classification Search

CPC ..... A47D 5/00; A47D 5/006; A47D 7/00; A47D 7/002; A47D 7/01; A47D 7/04; A47D 9/00; A47D 9/005; A47D 13/00; A47D 13/06; A47D 13/061; A47D 13/063

USPC ..... 5/98.1, 99.1, 93.1, 93.2, 97, 98.3, 655

See application file for complete search history.

(56) References Cited

U.S. PATENT DOCUMENTS

| | | | | | |
|---|---|---|---|---|---|
| 2,553,087 | A * | 5/1951 | Hanson | ..... | 5/93.1 |
| 3,848,277 | A * | 11/1974 | Reguitti | ..... | 5/11 |
| 5,349,709 | A | 9/1994 | Cheng | | |
| 5,555,577 | A * | 9/1996 | Volpe | ..... | 5/93.1 |
| 5,615,427 | A | 4/1997 | Huang | | |
| 5,918,329 | A | 7/1999 | Huang | | |
| 5,991,944 | A | 11/1999 | Yang | | |
| 6,131,218 | A * | 10/2000 | Wang | ..... | 5/93.1 |
| 6,430,762 | B1 | 8/2002 | Cheng | | |
| 6,434,767 | B1 | 8/2002 | Welsh, Jr. | | |
| 6,467,107 | B1 | 10/2002 | Glover et al. | | |
| 6,526,608 | B1 * | 3/2003 | Hsia | ..... | 5/99.1 |
| 7,055,191 | B1 | 6/2006 | Chen | | |
| 7,694,361 | B1 * | 4/2010 | Chen | ..... | 5/99.1 |
| 7,739,759 | B2 * | 6/2010 | Mendes et al. | ..... | 5/93.1 |

(Continued)

*Primary Examiner* — Robert G Santos
(74) *Attorney, Agent, or Firm* — Andrew D. Mead

(57) ABSTRACT

An improved bassinet frame for an infant playard comprising a plurality of structural members configured to nest within a playard top frame top and rest upon supports on corner members of the playard frame. The bassinet frame includes a pair of spaced-apart, parallel side members connected by a pair of perpendicularly aligned uplift preventing end members. The bassinet frame end members extend beneath playard frame end members when the bassinet frame is deployed for use such that the playard end frame members inhibit uplift of the bassinet frame. The side members each further include a joint positioned approximately midway along the respective lengths allowing the bassinet frame to be folded along an axis parallel to its width. Folding the bassinet frame retracts the end members from beneath the playard end frame members and allows the bassinet frame to be removed from the playard.

20 Claims, 9 Drawing Sheets

(56) References Cited

U.S. PATENT DOCUMENTS

| | | | | |
|---|---|---|---|---|
| 7,818,832 | B2 | 10/2010 | Hartenstine et al. | |
| 7,882,579 | B2 * | 2/2011 | Jackson et al. | 5/93.1 |
| 7,958,578 | B2 | 6/2011 | Shan et al. | |
| 8,141,186 | B2 * | 3/2012 | Burns et al. | 5/98.1 |
| 8,201,291 | B2 * | 6/2012 | Burns et al. | 5/93.2 |
| 8,307,475 | B2 * | 11/2012 | Hutchinson et al. | 5/93.1 |
| 8,566,988 | B2 * | 10/2013 | Son et al. | 5/690 |
| 2002/0092094 | A1 * | 7/2002 | Welsh, Jr. | 5/95 |
| 2003/0046761 | A1 * | 3/2003 | Hsia | 5/99.1 |
| 2009/0056013 | A1 * | 3/2009 | Hartenstine et al. | 5/93.1 |
| 2009/0077738 | A1 * | 3/2009 | Burns et al. | 5/93.1 |
| 2009/0077739 | A1 * | 3/2009 | Mendes et al. | 5/93.1 |
| 2009/0077740 | A1 * | 3/2009 | Jackson et al. | 5/93.1 |
| 2009/0077741 | A1 * | 3/2009 | Burns et al. | 5/93.2 |
| 2009/0077742 | A1 * | 3/2009 | Burns et al. | 5/93.2 |
| 2009/0113625 | A1 * | 5/2009 | Hutchinson et al. | 5/93.1 |
| 2009/0188039 | A1 * | 7/2009 | Shan et al. | 5/93.1 |
| 2011/0283457 | A1 * | 11/2011 | Son et al. | 5/690 |
| 2012/0036634 | A1 * | 2/2012 | Pacella | 5/93.1 |
| 2012/0233770 | A1 * | 9/2012 | Greger et al. | 5/98.1 |
| 2013/0117930 | A1 * | 5/2013 | Hsu | 5/93.1 |
| 2014/0068856 | A1 * | 3/2014 | Thomson et al. | 5/93.1 |
| 2014/0208505 | A1 * | 7/2014 | Burkholder et al. | 5/99.1 |

* cited by examiner

BASSINET FOR A PLAYARD

CROSS-REFERENCE TO RELATED APPLICATIONS

This application claims the benefit of priority of U.S. Provisional Application 61/453,501, filed Mar. 16, 2011.

BACKGROUND OF THE INVENTION

This invention relates generally to a children's playard, and more particularly to a playard having a selectively attachable bassinet that is easily and securely deployed for use.

Playards are small play enclosures for young children that include side walls and a bottom floor. Wall and floor panels are conventionally made of fabric material or similar soft goods connected to a collapsible frame to provide a lightweight, portable enclosure for infants and young children. It is known to enhance the usefulness of a playard by installing a bassinet therein to provide an elevated surface within the side walls and above the bottom floor from which infants are more readily accessible.

Connecting a bassinet to a playard requires connecting the bassinet frame to the playard frame in a secure manner capable of withstanding anticipated vertical and lateral forces. Such connections typically employ latches and the like to interconnect the bassinet frame and the playard frame. Connecting the bassinet to the playard should also be easily accomplished, requiring minimal concentration and dexterity from the user. Compromises to the latter objective are often necessary in order to meet the former, safety oriented objective. Further, the interconnecting means must be minimally intrusive on the playard when the bassinet is removed so that function and safety of the playard remains uncompromised. Significant advantages would be realized by providing a means for connecting a bassinet to a playard that could satisfy these objectives simultaneously.

It would be convenient to provide a portable playard for a small child featuring an easily installed and removed bassinet frame that overcomes the above limitations. Further advantages would be realized by a portable bassinet for use with a playard having improved floor support while retaining an easily foldable configuration that enables the bassinet to be collapsed and stowed without requiring additional actions to stow the floor supports.

SUMMARY OF THE INVENTION

Accordingly, the present invention, in any of the embodiments described herein, may provide one or more of the following advantages:

It is an object of the present invention to provide a connection means for positioning a bassinet in a playard that provide a secure connection, once installed, capable of withstanding anticipated forces. The playard frame comprises a plurality of upstanding frame members defining the corners of the playard. A plurality of horizontal frame members individually span between adjacent upstanding frame members to define a top perimeter frame. The horizontal frame members are generally straight, thereby defining a rectangular shape, when viewed in plan, comprising generally parallel and opposing spaced-apart sides and generally opposing and spaced-apart ends. A separate bassinet frame is provided with a plurality of structural members arranged to define a generally rectangular shape configured to concentrically nest within the top perimeter frame of the playard. A support ledge is included on each corner member connecting each upstanding frame member to the upper horizontal frame members providing a support upon which the corners of the bassinet frame may rest. Each support ledge includes a sufficient surface area to permit limited lateral movement (dependent upon the clearance between the nested frames of the playard and the bassinet) necessary for deploying the bassinet while preventing the bassinet frame from falling below the ledge when installed. The bassinet side frame members each include a lockable folding joint enabling the bassinet frame to be collapsed for storage and transport. The bassinet frame members include uplift preventing end members that extend beneath the playard horizontal end members when the bassinet frame is installed to engage the playard end frame members and inhibit uplift of the bassinet frame. The vertical spatial relationship between the support ledges and the playard top perimeter frame is chosen to allow the bassinet frame to be easily positioned during installation, but to limit vertical movement of the bassinet frame and minimize gaps between the playard and bassinet frame.

It is a further object of the present invention to provide a connection means for positioning a bassinet in a playard that is easily installable. A bassinet frame comprising a plurality of structural members arranged to define a generally rectangular shape configured to nest within a generally rectangular top perimeter frame of a playard. The bassinet frame includes a pair of generally opposing, parallel, and spaced-apart side members defining a length of the bassinet frame, the side members being connected by a pair of generally opposing end members to define a bassinet frame width. The side members each further include a joint positioned approximately midway along the length that allows the bassinet frame to be folded along an axis parallel to the width. The joints feature a travel stop which permits folding in one direction, but prevents folding in the opposite direction, allowing the bassinet frame to form a generally rigid perimeter frame to support the bassinet. The playard features a plurality of support ledges, one at each corner of the playard and proximate to the corners of the bassinet frame when unfolded upon which the corners of the bassinet frame rests. The bassinet frame also includes uplift preventing end members that extend beneath the playard horizontal end members when the bassinet frame is installed to engage the playard end frame members and inhibit uplift of the bassinet frame. The spatial relationship of the playard and bassinet frames and the uplift preventing end members are such that the bassinet frame may be unfolded to its operable configuration and moved downwardly into engagement with the playard. The support ledges are configured to minimize the likelihood that the bassinet frame corners will pass below the ledges during installation of the bassinet.

It is a further object of the present invention to provide a playard having a selectively installable bassinet that, when installed in an operable position, is substantially secured to the playard frame so as to preclude unintentional movement of the bassinet frame from the operable position. The bassinet installation features include a plurality of support pads on the playard frame that support the weight of the bassinet and child when the bassinet when installed and are minimize intrusion into the interior of the playard when the bassinet is removed. Minimizing intruding projections into the playard is essential for preventing small children from using such projections to climb out of the playard.

It is a still further object of the present invention to provide a selectively installable bassinet for a playard that includes a stiffening frame for improving stability of a bottom support pad in the bassinet. The bassinet includes a perimeter frame comprising a plurality of structural members arranged to define a generally rectangular shape configured to nest within a generally rectangular top perimeter frame of a playard. The perimeter frame includes a pair of generally opposing, parallel, and spaced-apart side frame members defining a length of the bassinet frame, the side frame members being connected by a pair of generally opposing end members to define a bassinet frame width. Side and end frame members are hingedly connected at the perimeters corners. Each side frame member further includes a folding joint positioned approximately midway along the length that allows the bassinet side frame members be folded along an axis parallel to the width. The bassinet frame supports an underslung fabric member having a generally vertical side wall extending downwardly from the bassinet perimeter frame and a bottom portion connected to the side wall, the side wall and bottom portion collectively defining an interior of the bassinet. One or more telescoping elongate tubes are attached to the bottom portion, each end of the telescoping tube being connected to the bottom portion adjacent to opposing ends of the bassinet. The tube is capable of extending to a first length when the bassinet is installed for use and collapsing to a second, shorter length for folding of the bassinet when not in use.

It is a still further object of the present invention to provide a playard with a selectively and easily installable bassinet that, once installed, precludes unintentional movement of the bassinet frame that is durable in construction, inexpensive of manufacture, carefree of maintenance, easily assembled, and simple and effective to use.

These and other objects are achieved in accordance with the present invention by a playard with an improved bassinet frame comprising a plurality of structural members arranged to define, when deployed for use, a generally rectangular shape configured to nest within a generally rectangular top perimeter frame of a playard and rest upon support projections provided on the playard frame corners. The frame includes a pair of generally opposing, parallel, and spaced-apart side members. The side members are connected by a pair of generally opposing uplift preventing end members. The uplift preventing end members extend beneath the playard horizontal end members when the bassinet frame is deployed for use in the playard to engage the playard end frame members and inhibit uplift of the bassinet frame. The side members each further include a joint positioned approximately midway along the length that allows the bassinet frame to be folded along an axis parallel to the width. Folding the bassinet frame retracts the end members from beneath the playard end frame members and allows the bassinet frame to be removed from the playard.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined as the playard would normally rest on the floor or a similarly level surface. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
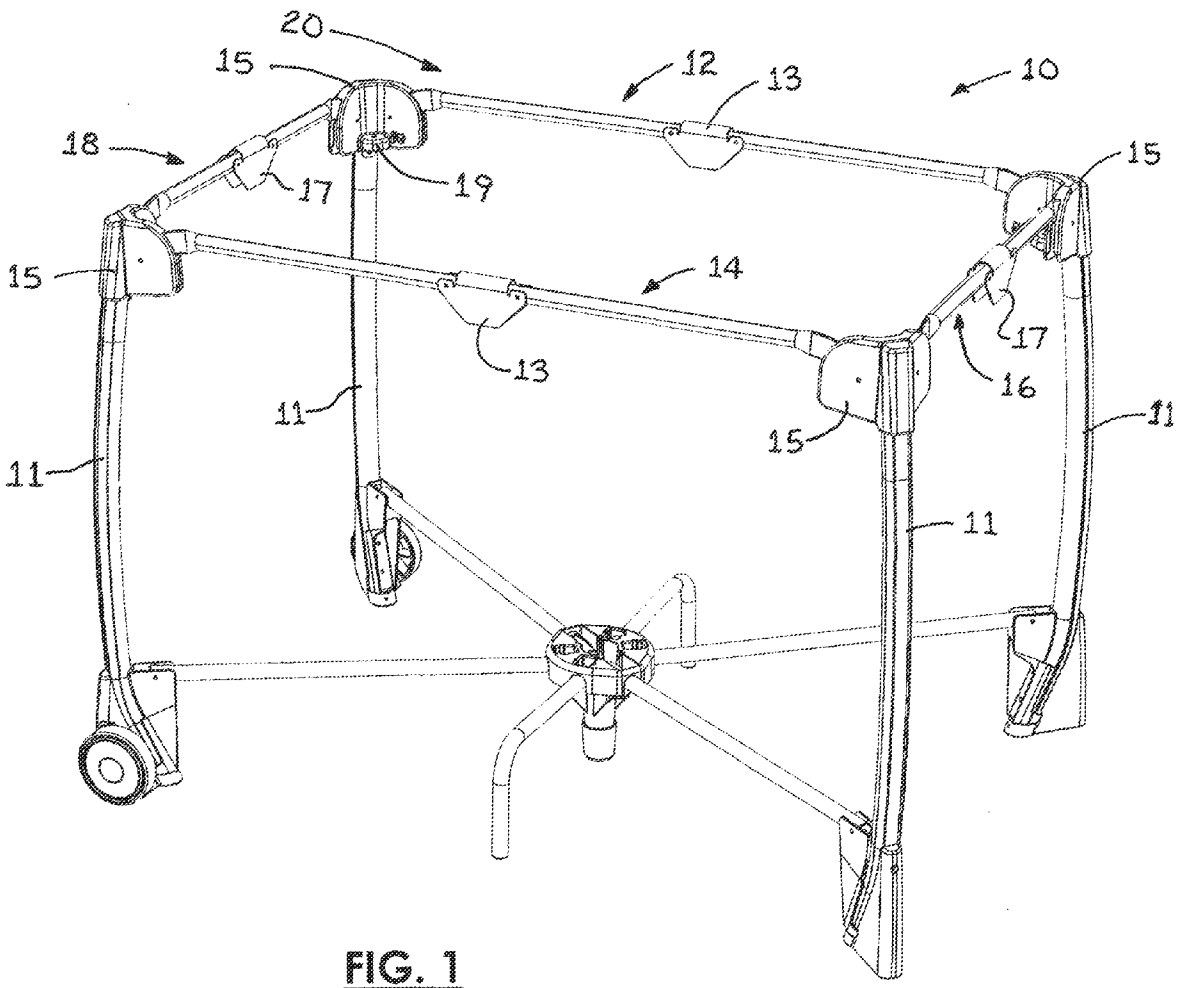
FIG. 1 is a perspective view of the frame of a conventional playard on which the present invention is useful.

A playard frame 10 is shown in FIG. 1 comprising at pair of generally opposing and spaced-apart upper side rail members 12, 14 and a pair of generally opposing upper end rail members 16, 18 disposed between the opposing side rail members to form an upper perimeter frame 20 of the playard. The upper side rail members 12, 14 typically are connected to the end rail members 16, 18 and other structural members, such as upright legs 11 by corner brackets 15 to establish the playard frame 10 having a generally rectangular upper perimeter frame 20. It is well known for side rail members 12, 14 and end rail member 16, 18 to include folding connectors 13, 17, respectively, typically positioned midway between respective corner brackets 15, enabling the rail members to be folded in a manner to allow the playard frame to be collapsed into an easily transportable configuration. Playard frame 10 is conventionally covered in fabric material to create wall and floor panels to contain a small child while leaving the area surrounded by the upper perimeter frame open. It should be noted that the shape and number of corner brackets shown are exemplary only and other such brackets may also be used to provide the requisite attachment.

For clarity of description of the present invention, the playard frame 10 is shown in an erected position as it would be positioned during use of the invention and the fabric material covering has been omitted.

Referring to FIGS. 2 through 9, a bassinet frame 30 embodying the present invention is shown comprising a pair of side frame members 32, 34 and a pair of end frame members 36, 38 generally perpendicularly oriented thereto. Side frame members 32, 34 each include a folding hinge device 37 intermediately disposed along the length of the side frame members thereby creating first 32*a*, 34*a* and second frame member portions 32*b*, 34*b* of the side frame members. Hinge devices 37 allow each side frame member to be angularly deflected in a first direction toward a folded position and limit deflection of the side frame members in the opposite direction so that the respective side frame member portions 32*a*, 32*b*, 34*a*, 34*b* are generally linearly aligned when configured in an extended position or deployed position of the bassinet frame 30. The side frame members 32, 34 and the end frame members 36, 38 are connected by corner joints 39 to maintain the side and end frame members in relationship to form a generally rectangular frame structure when the bassinet frame is in the deployed position. Corner joints 39 preferably include provisions to allow the one or both of the connected frame members to be folded inwardly towards one another to aid in storage or portability of the bassinet frame 30.

Side frame members 32, 34 are generally straight and are positioned generally parallel to the side rail members 12, 14 of the playard upper perimeter frame 20 when the bassinet frame 30 is installed for use in the playard. The length of the bassinet frame 30 in the extended position as established by the side frame members 32, 34 is slightly less than the length of the upper perimeter frame 20 and established so that the corners 39 of the bassinet frame 30 will overlay the bassinet support members 19 provided on each corner piece 15 and remain laterally constrained by interaction with the interior surfaces 151 of the playard corner brackets 15. Clearance between the bassinet frame 30 and the interior surfaces 151 of the corner brackets is sufficient to allow the bassinet frame to be easily installed and removed from the playard, while limiting movement to the degree necessary to assure that the bassinet frame will remain supported by support members 19 when installed. Bassinet support members 19 are vertically located to position the bassinet frame 30 slightly below the playard upper perimeter frame 20. Vertical spacing between the upper perimeter frame 20 and the bassinet frame 30 is sufficiently minimized to prevent introduction of an infant or child's head from the vertical space between the members. While shown integral to corner brackets 15, support members 19 may also be separate structures from the corner brackets 15 to allow the support members 19 to be removed from the playard when the bassinet frame 30 is not installed.

Figure 2:
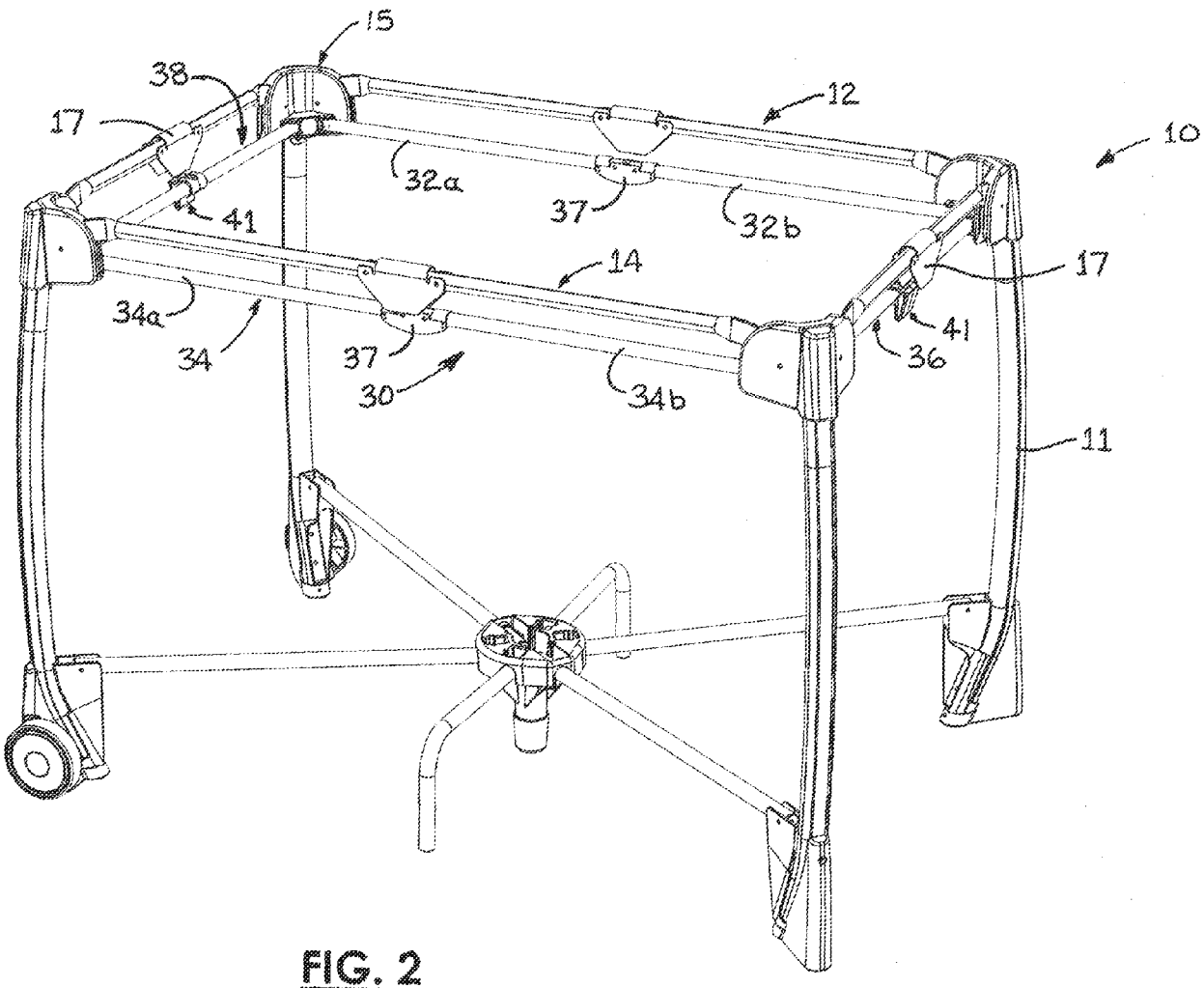
FIG. 2 is a perspective view of the playard frame of FIG. 1 showing the nesting relationship of a bassinet frame incorporating a first embodiment of the present invention in the installed or operable configuration.
Figure 3:
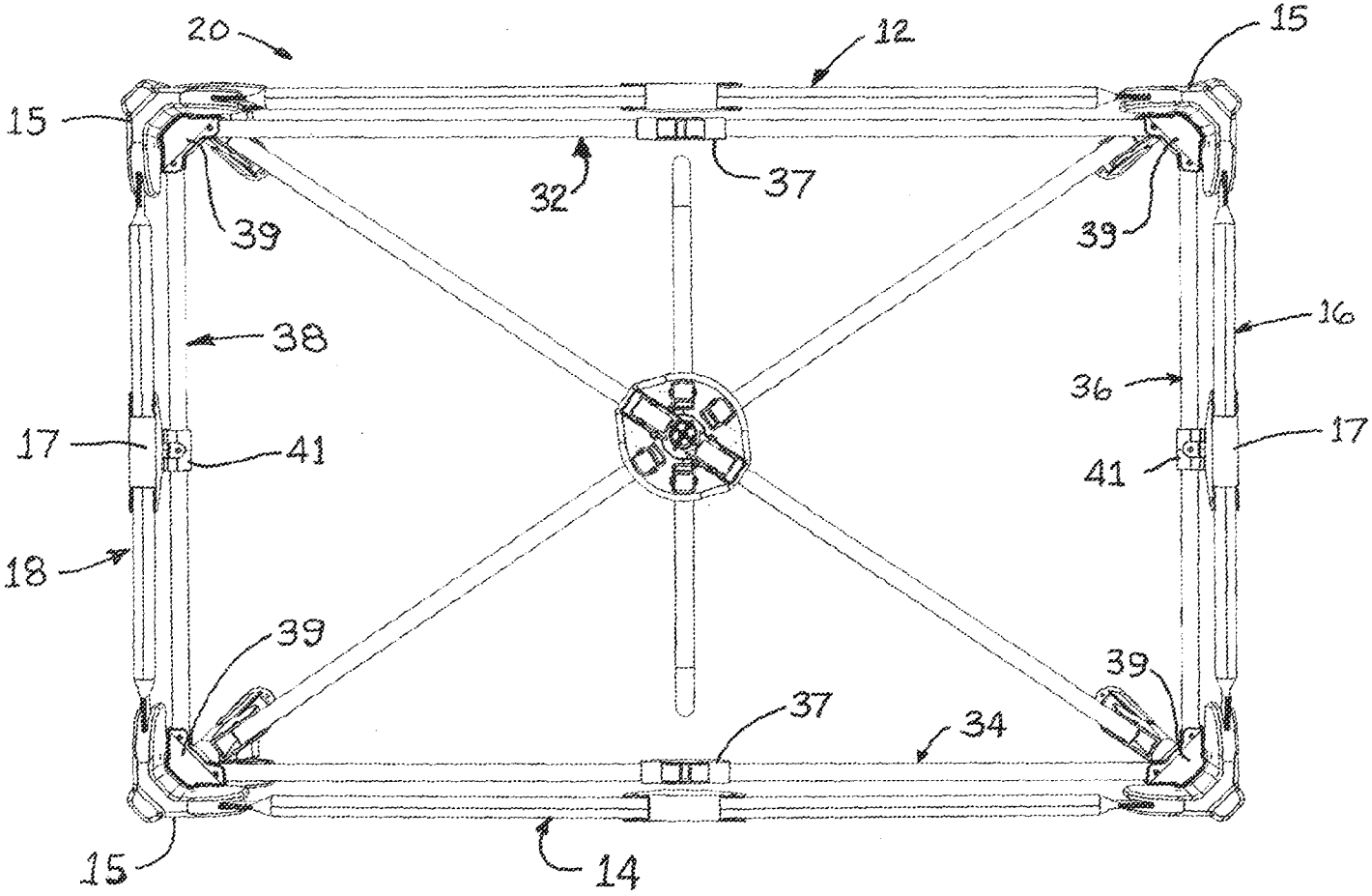
FIG. 3 is a plan view of the bassinet frame of FIG. 2 installed for use in the playard.
Figure 4:
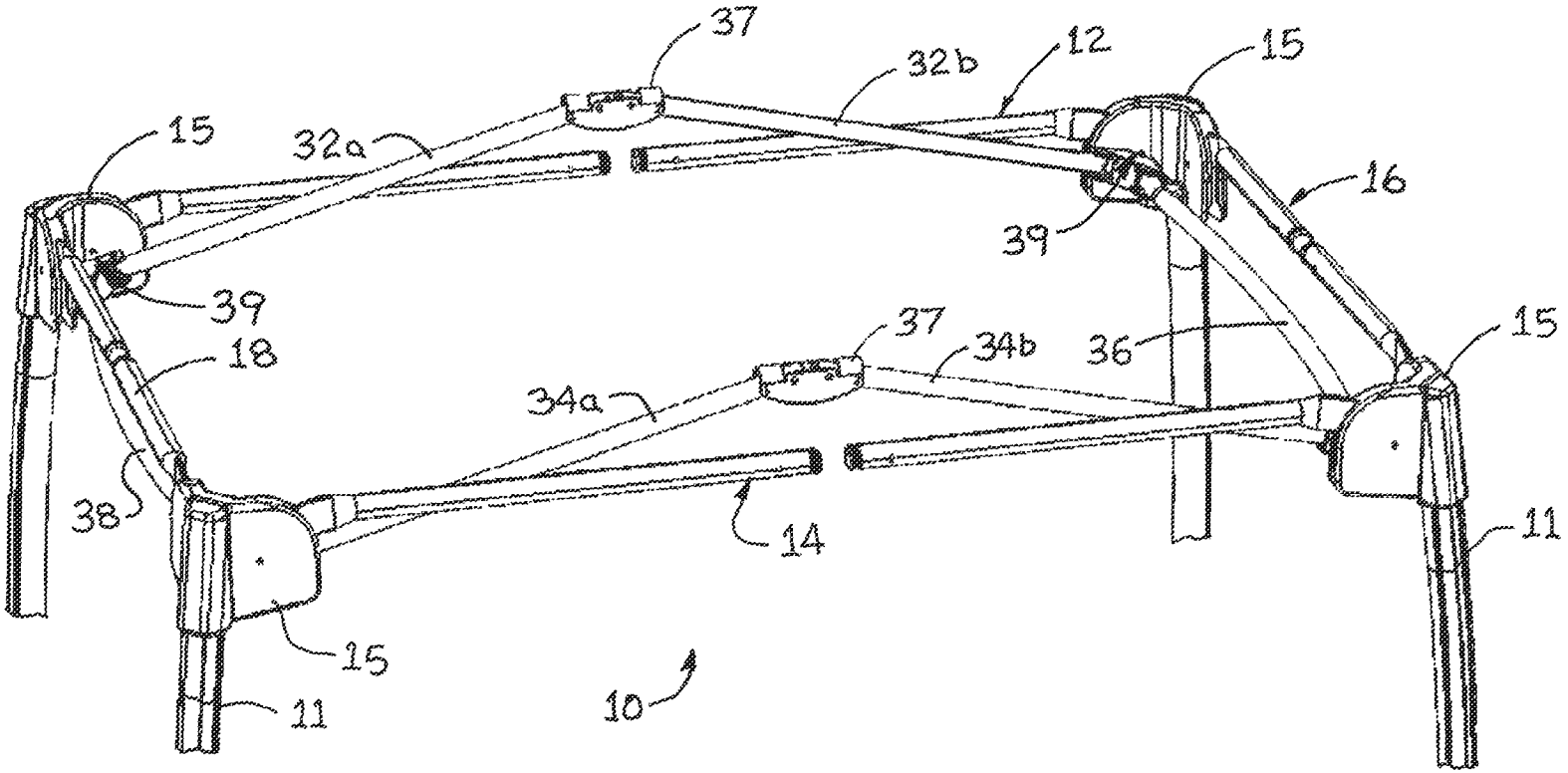
FIG. 4 is a perspective view of the playard and bassinet frames showing a second embodiment of the bassinet frame in a partially folded position as would be necessary to remove the bassinet frame from the playard.
Figure 6:
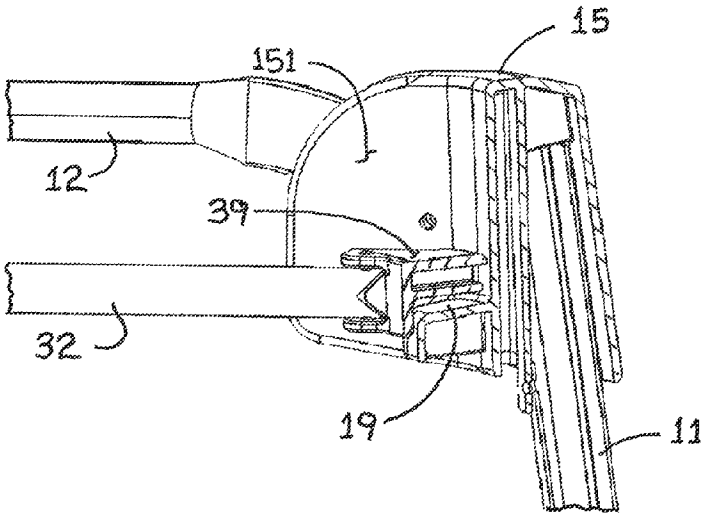
FIG. 6 is a section view of the interface between the bassinet frame and the frame corner support member.
Figure 5:
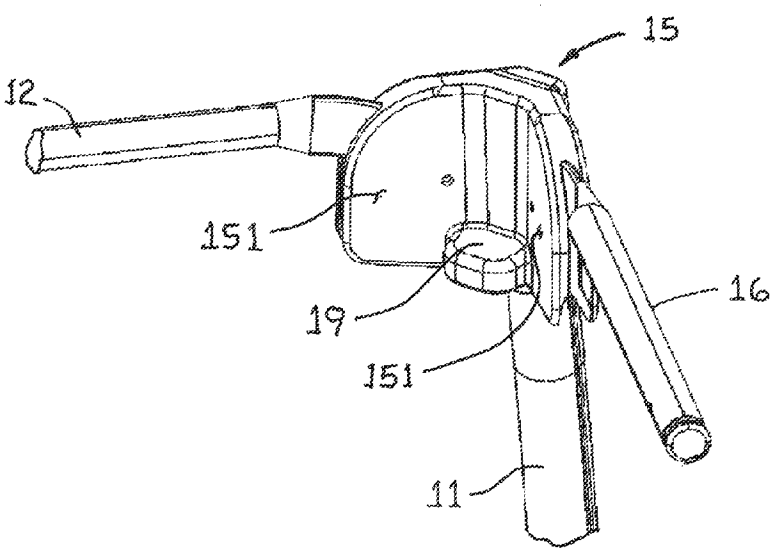
FIG. 5 is a detail view of one of a plurality of upright frame corner members of the playard frame from FIG. 1 showing a first embodiment of a support member of the present invention.
Figure 9:
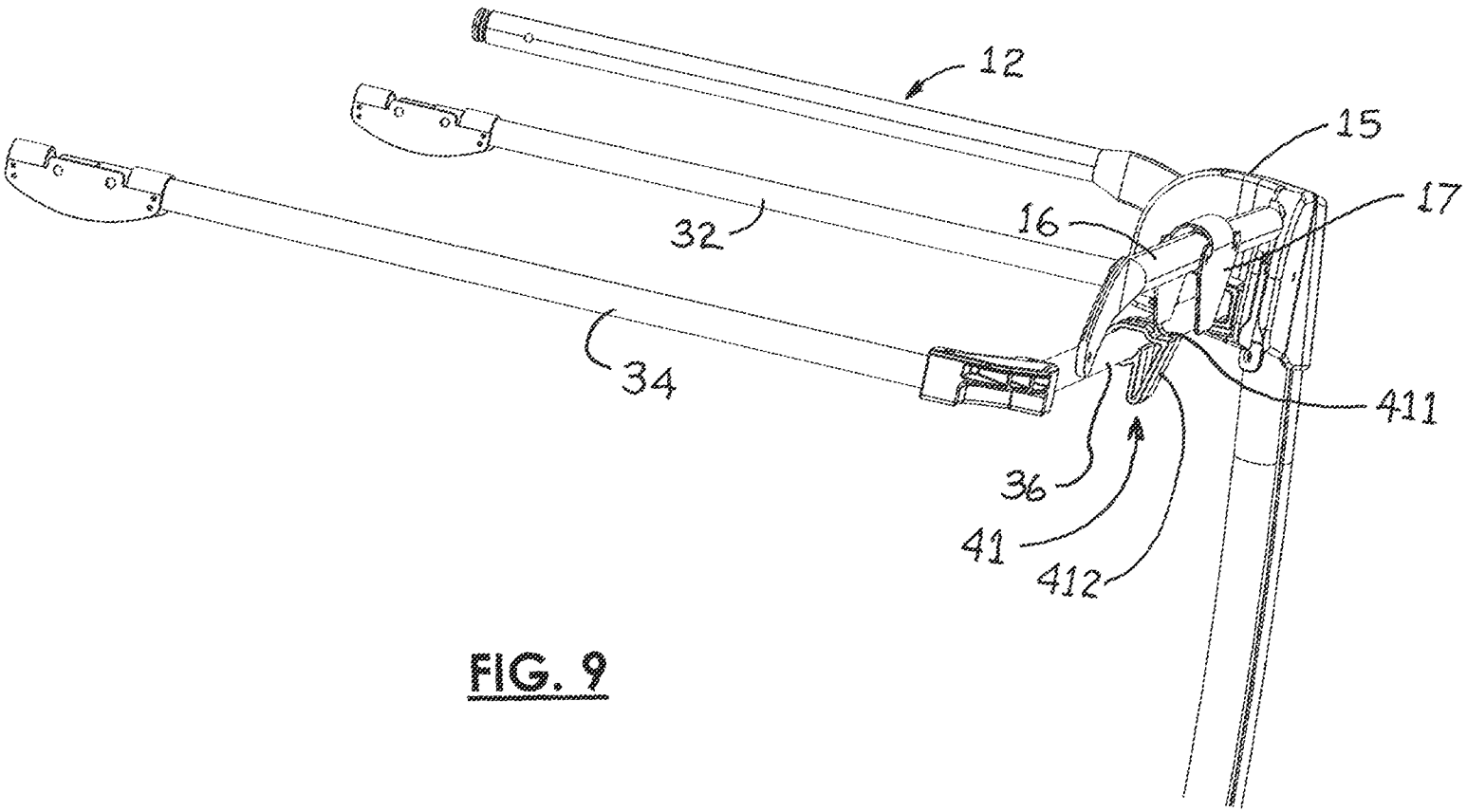
FIG. 9 is a partial perspective view of one end of the playard and bassinet frame members with one embodiment of an uplift inhibitor showing the spatial relationship thereof.

In a first embodiment of the invention, bassinet end frame members 36, 38 are aligned generally parallel and closely adjacent to the end rail members 16, 18 of the playard. An uplift inhibitor 41 is attached to each end member 36, 38 of the bassinet frame as best illustrated in FIGS. 2 and 9. Each uplift inhibitor 41 projects outwardly from its respective bassinet end frame member 36, 38 and extends beneath the adjacent end rail members 16, 18 of the playard frame when the bassinet frame is in the extended or operable position and installed for use in the playard. In the embodiment shown, catch surface 411 is configured to contact the underside of the playard end frame member, preferably a lower end portion of the hinge 17 to prevent vertical uplift when the inhibitor 41 is engaged. Uplift inhibitor 41 may also include an angled engagement surface 412 to aid in the installation of the bassinet frame into the playard for use. Uplift inhibitor is preferably formed from a resilient material, such as plastic, and designed so that a normal force applied on the engagement surface 412 causes the device 41 to deflect inwardly as it contacts the end frame rail or hinge of the playard until the bassinet frame is moved downwardly sufficiently for the catch surface to extend below the playard end frame rail or the lower edge 171 of the hinge thereby allowing the inhibitor 41 to return to its normal, undeflected position and inhibit upward bassinet frame movement.

Figure 7:
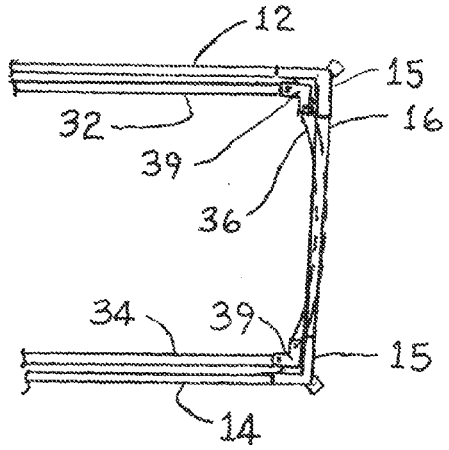
FIG. 7 is a partial plan view of one end the playard frame of FIG. 1 showing a bassinet frame incorporating the second embodiment of the present invention and the relationship of the convex portion of the end frame rail and the bassinet frame.
Figure 8:
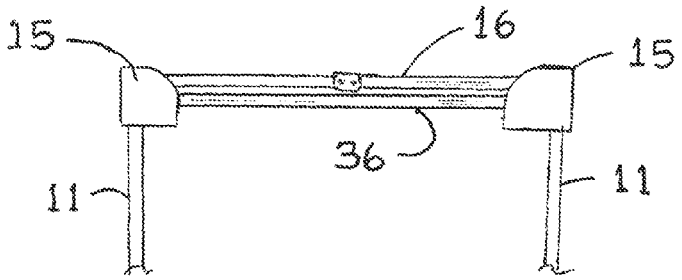
FIG. 8 is an elevation view of one end of the playard frame of FIG. 7 showing the vertical relationship between the playard upper frame rail and the bassinet end frame member.

In a second embodiment, bassinet end frame members 36, 38 are slightly curved and convexly oriented to the perimeter of the bassinet frame when in the extended position. When the bassinet frame 30 is installed in the playard frame 10 and moved into the extended position as shown in FIGS. 7 and 8, a portion of the end frame members 36, 38 extends beneath the end rail members 16, 18, respectively, so that significant upward movement of the bassinet frame 30 is limited by the vertical space between the upper perimeter frame 20 and the bassinet frame 30.

Removal of the bassinet frame 30 is accomplished by folding the frame 30, as enabled by hinge devices 37, from the deployed position toward the folded position. Folding reduces the overall distance separating the end frame members 36, 38 thereby withdrawing the uplift inhibitor or the convex end frame member from below the playard end frame rail and allowing the bassinet frame 30 to be moved upwardly and removed from the playard (refer to FIG. 4). Hinge devices 37 are oriented so that the weight of the bassinet or the weight of an infant placed in the bassinet while in use will bias the hinge device toward the extended position and resist the upward motion necessary to reposition the bassinet frame toward the folded position. A locking device or the like may also be included in the hinge device 37 thus requiring an additional releasing step before the hinge device 37 may be moved away from the extended position allowing the bassinet to be removed. This additional release step further safeguards against unintentional folding of the bassinet frame 30.

Figure 10:
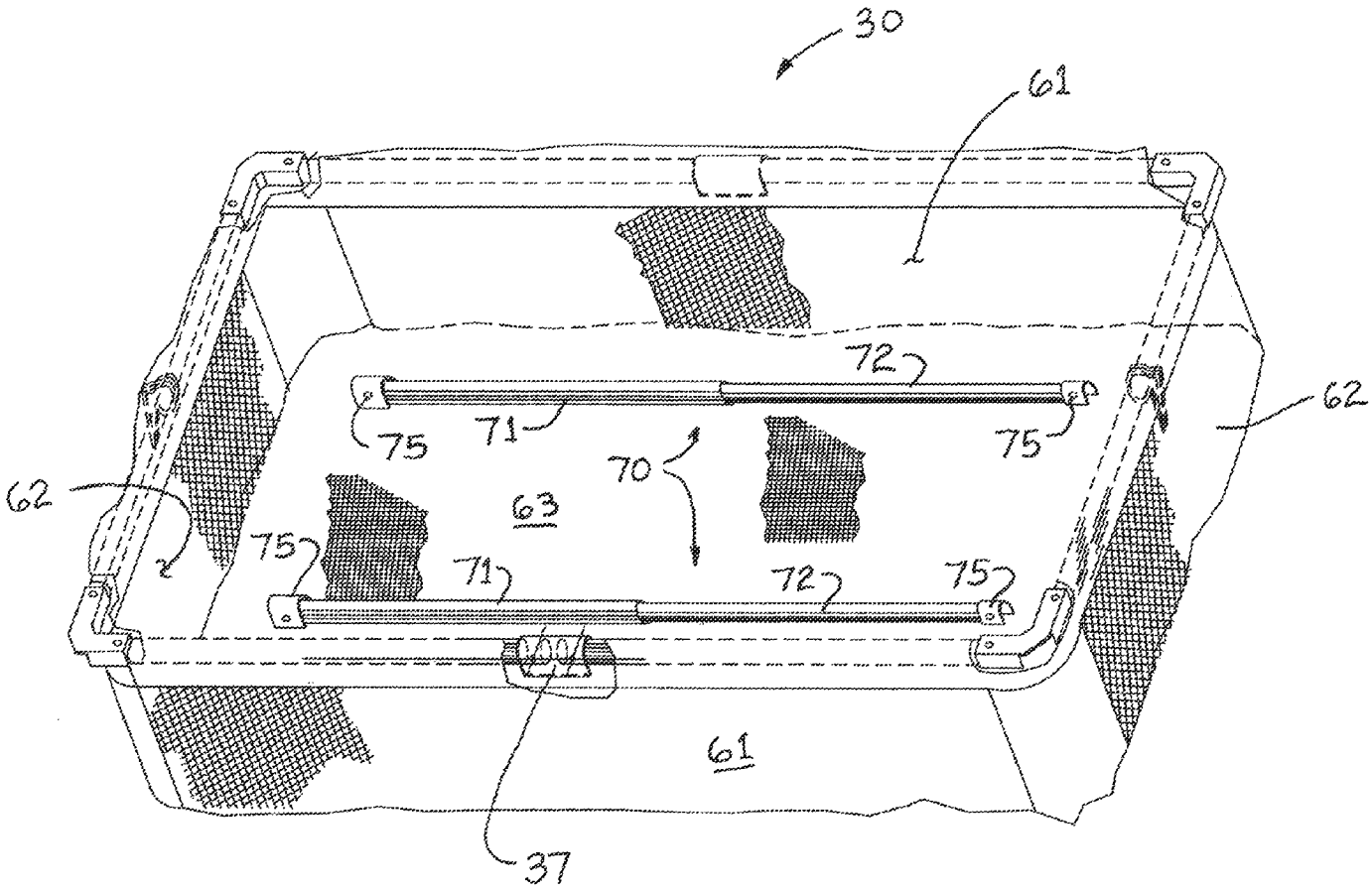
FIG. 10 is a perspective view of the bassinet frame shown in FIGS. 2 and 3 including a fabric wall and floor panels and floor stiffening members.
Figure 12:
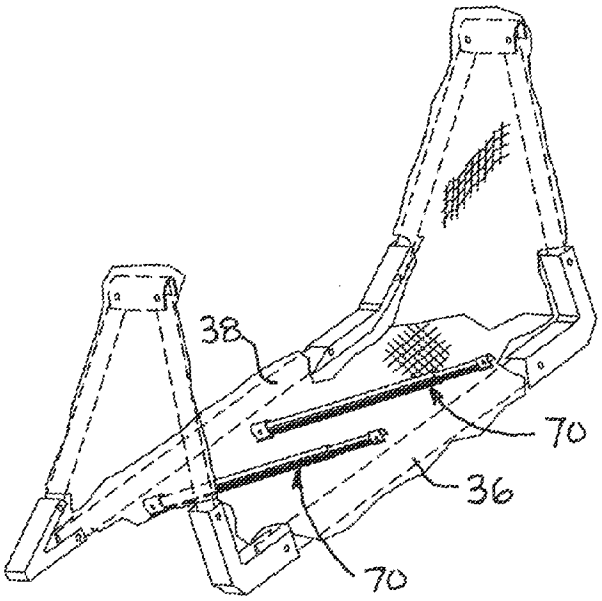
FIG. 12 is a view of the bassinet of FIG. 11 folder further to illustrate movement of the floor stiffening members as the bassinet is folded for storage or transport.
Figure 11:
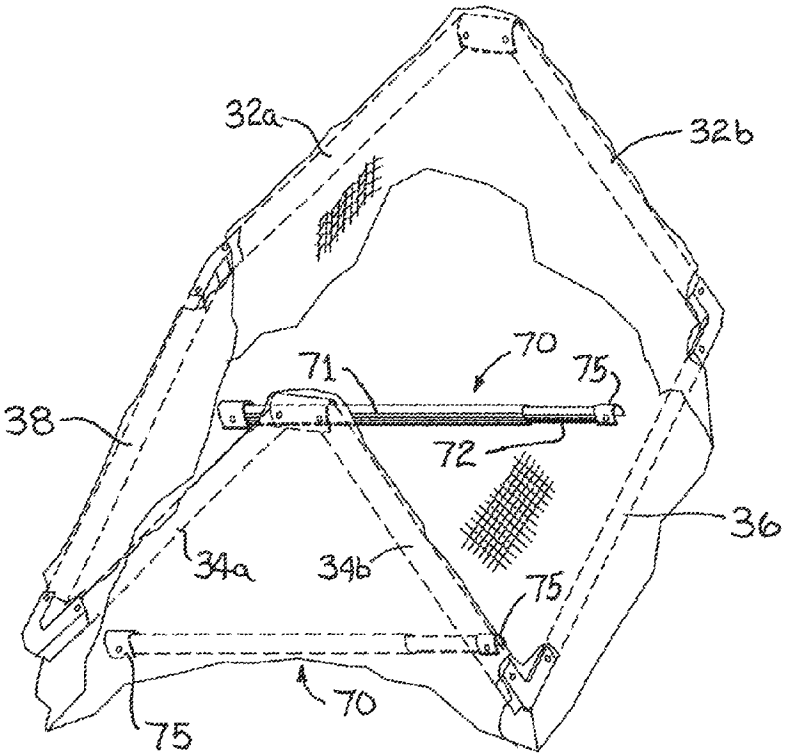
FIG. 11 is a view of the bassinet of FIG. 10 in a partially folded position showing the floor stiffening members in a collapsed position.

Now referring to FIGS. 10 through 12, the bassinet frame 30 is shown with fabric covering 60 defining the bassinet with a plurality of generally vertically suspended side panels 61, 62 and a generally horizontally arranged bottom panel 63 spanning and connecting the lowermost edges of the side panels. A removable bottom pad (not shown) is typically inserted to stiffen the bottom panel and enable the bassinet to support the weight of an infant while maintaining a generally planar bottom support surface. Such suspended bassinets are well known in the art of playards. The present invention improves upon the state of the art through the addition of first and second elongate stiffeners 70 connected to the fabric of the bottom panel 63. Each stiffener 70 includes a first sliding portion 71 and a second sliding portion 72, each portion having a connection 75 at one end to the fabric of the bottom panel 63 and telescopically engaged with each other at the non-connected ends. The connections 75 are positioned adjacent to the juncture of the end side panels 62 and the bottom panel 63 so that the stiffeners will remain generally horizontal when the bassinet is installed in the playard.

The length of each stiffener 70 may vary via the telescoping connection from an extended length corresponding to the bassinet being deployed for use, shown in FIG. 10, and a retracted length corresponding to the bassinet in the folded condition, shown in FIGS. 11 and 12. FIG. 11 shows the bassinet in a partially folded position in which the stiffeners 70 are collapsed to their retracted length so that the bassinet frame 30 may be folded for storage. The stiffeners 70 are fully retracted, but remain generally parallel to the side rails 32, 34 of the bassinet frame. Further folding movement at the hinge devices 37 as illustrated in FIG. 12 requires the stiffeners 70 to angle away from a parallel alignment with the side rails 36, 38 and move toward a generally parallel alignment with the end rails 36, 38. Connections 75 attach the stiffeners 70 directly to the bottom panel 63 fabric which enables greater flexibility in the movement of the stiffeners than would be provided by a connection with the bassinet frame 30 thereby allowing the bassinet frame and bottom stiffeners 70 to be conveniently folded for storage without requiring removal or disconnection of the stiffeners from the bassinet.

The benefits of telescoping stiffeners 70 are not limited to removable bassinets incorporating uplift inhibitors as described above; such stiffeners improve the utility of any underslung bassinet selectively installed in a playard regardless of the means for connecting the bassinet. Some bassinets even lack upper perimeter frames, instead relying on the upper frame members of the playard to support the down hanging fabric and establish a perimeter for the bassinet. Use of the telescoping stiffeners as described herein as a selectively installable bassinet accessory for a playard is therefore within the scope and spirit of the invention described herein.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A playard comprising:

a generally rectangular, horizontally arranged first frame having a pair of spaced-apart generally parallel upper side frame rails and a pair of generally parallel upper end frame rails generally perpendicularly aligned to said upper side frame rails and having an interior length and an interior width;

a plurality of retainers disposed at the corners of said first frame;

a second frame having first and second spaced-apart and generally parallel elongate side rails, first and second spaced-apart end rails connected to respective opposing ends of said side rails and generally perpendicularly arranged thereto, said second frame having an external width that fits within said first frame and an external length;

first and second adjusters intermediately disposed on said first and second side rails, respectively, said first and second adjusters enabling said second frame to be positioned between extended and retracted positions, said external length being less than said interior length when said second frame is in said retracted position and said external length is greater than said interior length when said second frame is in said extended position, said retainers supporting said second frame at a fixed height below said first frame, and at least a portion of said first and second end rails being disposed under said first frame when said second frame is in said extended position whereby uplift of said second frame is inhibited by interaction between said first and second portions with said first frame.

2. The playard of claim 1, wherein said first and said second adjusters are folding joints enabling said side rails to be angularly deflected, said extended position aligning said side rails generally linearly and movement toward said retracted position angles said side rails.

3. The playard of claim 2, wherein said first and second portions are convex curves of said first and said second end rails.

4. The playard of claim 2, wherein said first and second portions includes an inhibitor member connected to and projecting outwardly from at least one of said end rails.

5. The playard of claim 4, wherein said inhibitor member is made from a resilient material.

6. The playard of claim 5, wherein said resilient inhibitor member further comprises a catch surface generally horizontally projecting outwardly from at least one of said end rails, and an engaging surface angled in relation to said catch surface, said engaging surface positioned to contact a portion of one of said upper end frame rails as the second frame is moved toward said extended position to inwardly deflect said engaging surface and adjacently pass said end frame rail, said engaging surface adjacent releasing contact with said upper end frame rail once said catch surface passes said upper end frame rail thereby allowing said resilient member to return to an undeflected condition.

7. The playard of claim 1, further comprising a fabric body supported on said second frame, said fabric body having a side wall connected to said second frame encircling a bottom panel, and at least one stiffener having a first portion and a telescopically engaged second portion enabling stiffener movement between first and second lengths, said first and second portions each having a connector disposed distal from said telescoping engagement, said connector affixed to said bottom panel adjacent to said side wall to align said at least one stiffener generally parallel to said side rails wherein said at least one stiffener extends to said first length when said second frame is in said extended position for use and said least one stiffener retracts to said second length when said second frame is moved toward said retracted position enabling said second frame to be collapsed without disconnecting said at least one stiffener from said fabric body.

8. The playard of claim 7, wherein said second frame further comprises foldable connectors joining respective side rails and end rails.

9. A playard comprising:

a main frame structure having a plurality of upstanding legs, a pair of spaced-apart generally parallel upper side frame rails, a pair of generally parallel upper end frame rails generally perpendicularly aligned to said upper side frame rails, and a plurality of main frame corner members connecting the upper frame rails to define a generally horizontal upper perimeter having an interior length dimension, said main frame corner members also connecting the upstanding legs to support said upper frame rails in a generally horizontal plane at a height above a surface;

a collapsible second frame having first and second generally parallel and spaced-apart elongate side tubes, each with an intermediately disposed folding joint enabling movement of said second frame between folded and extended positions, and first and second end tubes generally perpendicularly aligned to said side tubes when in said extended position, each having an uplift inhibiting portion, and each connected to a respective end of said first and second side tubes defining a generally rectangular frame perimeter when in said extended position; and a retainer structure provided on each main frame corner member, said retainer structures configured to receive said second frame in an operable position wherein said side tubes are generally parallel to said side frame rails when in said extended position, said retainer structure when operably positioned vertically supporting said second frame at a fixed height below said upper frame rail height and inhibiting horizontal movement of said second frame;

each of said first and second end tubes having an uplift inhibitor portion configured to define a length of said second frame when in said extended position that is greater than said interior length dimension whereby said uplift inhibitor portions extend beneath said upper end frame rails and inhibit uplift of said second frame relative to said main frame structure, and said second frame length is less than said interior length dimension when said second frame is moved toward said folded position enabling said second frame to be disengaged from said main frame structure.

10. The playard of claim 9, wherein said uplift inhibitor portion is a convex curve of said first or said second end tube.

11. The playard of claim 9, wherein said uplift inhibitor portion is a convex curve of each of said first and said second end tubes.

12. The playard of claim 9, wherein said uplift inhibitor portion includes an inhibitor member connected to and projecting outwardly from at least one of said end tubes.

13. The playard of claim 12, wherein said inhibitor member is made from a resilient material.

14. The playard of claim 13, wherein said resilient inhibitor member further comprises a catch surface generally horizontally projecting outwardly from at least one of said end tubes, and an engaging surface angled in relation to said catch surface, said engaging surface positioned to contact a portion of one of said upper end frame rails as the second frame is moved toward said extended position to inwardly deflect said engaging surface and adjacently pass said end frame rail, said engaging surface adjacent releasing contact with said upper end frame rail once said catch surface passes said upper end frame rail thereby allowing said resilient member to return to an undeflected condition.

15. The playard of claim 12, wherein said uplift inhibitor portion is an inhibitor member connected to and projecting outwardly from each of said first and said second end tubes.

16. The playard of claim 9, further comprising a fabric body supported on said second frame, said fabric body having a side wall connected to said second frame encircling a bottom panel, and at least one stiffener having a first portion and a telescopically engaged second portion enabling stiffener movement between first and second lengths, said first and second portions each having a connector disposed distal from said telescoping engagement, said connector affixed to said bottom panel adjacent to said side wall to align said at least one stiffener generally parallel to said side tubes wherein said at least one stiffener extends to said first length when said second frame is in said extended position for use and said least one stiffener retracts to said second length when said second frame is moved toward said retracted position enabling said second frame to be collapsed without disconnecting said at least one stiffener from said fabric body.

17. The playard of claim 16, said second frame further comprises foldable connectors joining respective side tubes and end rails.

18. A playard comprising:

a main frame structure having a plurality of upstanding legs supporting a generally rectangular, horizontally arranged upper frame defining an upper plane of a length and a width;

a lower floor structure defining a lower plane generally parallel to and spaced apart from said upper plane by a height, said lower floor structure supported by said plurality of upstanding legs;

a collapsible fabric body selectively supportable on said upper frame, said fabric body configured to nest within said upper frame when installed and having a side wall encircling a generally rectangular bottom panel intermediately disposed between said upper and lower planes; and at least one stiffener having a first portion and a telescopically engaged second portion enabling stiffener movement between first and second lengths, said first and second portions each having a connector disposed distal from said telescoping engagement, said connector affixed to opposing ends of said bottom panel adjacent to said side wall aligning said at least one stiffener generally parallel to said length of said upper frame, wherein said at least one stiffener extends to said first length when said fabric body is installed for use in said playard and said least one stiffener may be retracted to said second length when said fabric body is removed from said playard.

19. The playard of claim 18, further comprising a second frame having first and second spaced-apart and generally parallel elongate side rails, first and second spaced-apart end rails connected to respective opposing ends of said side rails and generally perpendicularly arranged thereto, each said side rail with an intermediately disposed folding joint enabling movement of said second frame between folded and extended positions said collapsible fabric body being connected to and supported by said second frame.

20. The playard of claim 19, said second frame further comprises foldable connectors joining respective side rails and end rails.

* * * * *